US006184843B1

(12) United States Patent
Minks et al.

(10) Patent No.: US 6,184,843 B1
(45) Date of Patent: Feb. 6, 2001

(54) EXTENDABLE/STOWABLE ANTENNA

(75) Inventors: Dan Earl Minks, Gilbert; Gordon Craig Henderson, Scottsdale; James Lee Isbell, Phoenix, all of AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 09/414,112

(22) Filed: Oct. 7, 1999

(51) Int. Cl.[7] ..... H01Q 1/10

(52) U.S. Cl. ..... 343/883; 343/878; 343/880; 343/901

(58) Field of Search ..... 343/702, 785, 343/872, 878, 880, 883, 890, 891, 892, 901; 318/85, 588; 403/320; 483/1, 27; 29/741, 835; H01Q 1/10

(56) References Cited

U.S. PATENT DOCUMENTS 4,283,836 * 8/1981 Janisiewicz et al. ..... 29/564.1
4,739,236 * 4/1988 Burkenpas ..... 318/588
5,613,929 * 3/1997 Bayer ..... 483/1
5,795,093 * 8/1998 Seaton et al. ..... 403/322

* cited by examiner

*Primary Examiner*—Tho Phan
(74) *Attorney, Agent, or Firm*—Frank J. Bogacz

(57) ABSTRACT

Extendable/stowable antenna apparatus includes a molded elongated antenna stem with fixed and free ends. The stem is molded with an outer bearing surface, anti-rotation surfaces extending between the fixed and free ends, and a detent surface including a detent stow slot and a detent extend slot. A molded antenna radome includes an elongated opening molded therein with a mating inner bearing surface and anti-rotation surfaces designed to mate with the outer bearing surface and the anti-rotation surfaces of the stem. The opening slidably engages the stem for sliding movements between a stow position and an extended position at the free end. A spring biased detent mechanism in the opening engages the detent stow slot in the stow position and the detent extend slot in the extended position.

21 Claims, 2 Drawing Sheets

EXTENDABLE/STOWABLE ANTENNA

FIELD OF THE INVENTION

This invention relates to antennas using extended and stowed positions.

More particularly, the present invention relates to apparatus for positioning an antenna from a stowed position to an extended position and for maintaining the antenna in either position.

BACKGROUND OF THE INVENTION

This invention applies to antennas using extended and stowed positions or other mechanisms using multiple detent positions. Existing technology incorporates separate bearings into the antenna which include anti-rotation and detent features. However, the addition of the separate bearings between an antenna stem and the antenna results in additional tolerance stackup and assembly difficulties. Because the bearings are separate parts, additional features are required in the antenna to contain the bearings. The tolerance stackups can permit malfunction of the anti-rotation features, poor sliding performance, and poor detenting performance. Further, the separate components and additional assembly steps add substantially to the cost. In addition, because of the separate bearing the antenna cannot physically accommodate a smaller antenna element because the bearing fits inside of the element and, therefore, the bearing size controls the element diameter.

Accordingly it is highly desirable to provide apparatus which overcomes these problems and which is inexpensive and easy to install and use.

BRIEF DESCRIPTION OF THE DRAWINGS

Referring to the drawings.

DESCRIPTION OF THE PREFERRED EMBODIMENTS

Figure 1:
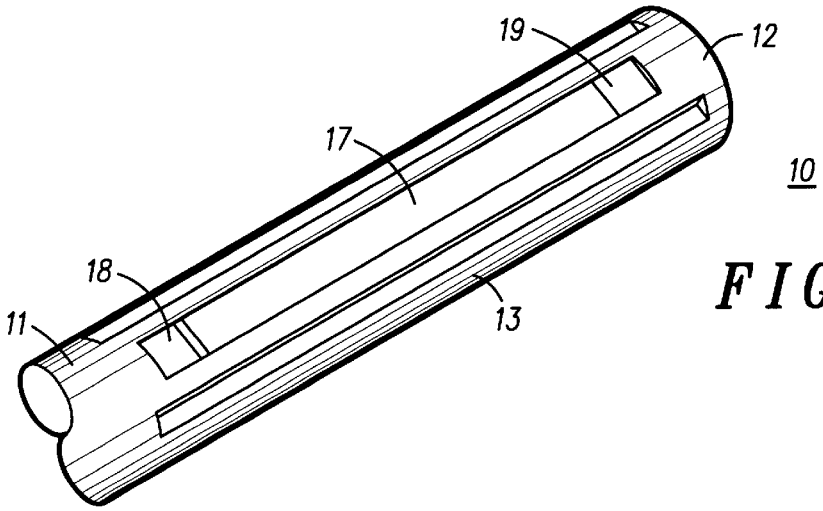
FIG. 1 is an isometric view of a stem for mounting an antenna or other detent apparatus in accordance with the present invention.
Figure 2:
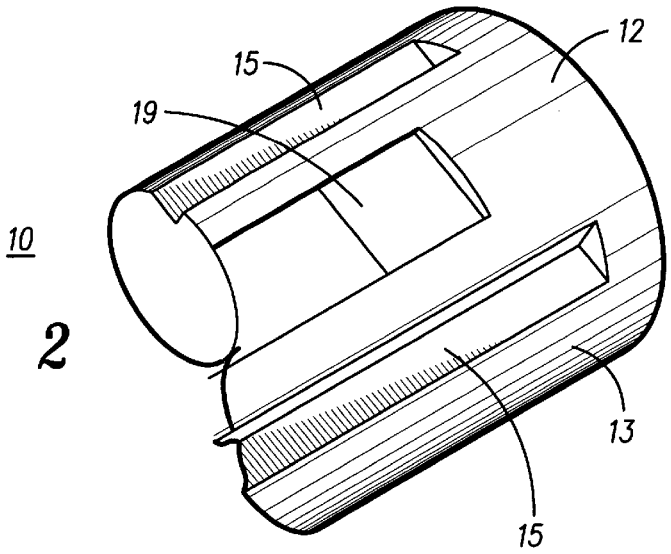
FIG. 2 is an enlarged view of a portion of the stem of FIG. 1.

Turning now to the drawings and specifically to FIGS. 1 and 2, an elongated stem 10 in accordance with the present invention is illustrated. Stem 10 has a fixed end 11 which is attached to a device, such as a telephone or radio that is designed to incorporate an antenna, or other mechanisms using multiple detent positions. An opposed or free end 12 is spaced from fixed end 11 a distance which the antenna or other mechanism is desired to move. In this specific example, stem 10 is used to slidably mount an antenna which is designed for use with portable electronics equipment, such as a telephone, radio, etc.

Elongated stem 10 includes an outer bearing surface 13 and at least one anti-rotation surface 15 (two are illustrated in this embodiment) extending from adjacent fixed end 11 to adjacent free end 12. Further, a detent surface 17 is formed in the outer surface of stem 10. Detent surface 17 includes a detent stow slot 18 formed adjacent fixed end 11 of stem 10 and a detent extend slot 19 formed adjacent free end 12 of stem 10. In this preferred embodiment, anti-rotation surfaces 15 are slots with a generally triangular (arcuate) cross-section to provide positive anti-rotation, as will be explained in more detail presently. It will be understood, of course, that other anti-rotation surfaces, such as different shaped slots or an oval cross-section for stem 10, could be used if desired or if more convenient in specific applications. Generally, when dealing with very small diameter parts (e.g. telephone or radio antennas) it is impractical to form them with other than round cross-sections, hence the need for some type of slot-shaped anti-rotation surfaces.

In this preferred embodiment stem 10 is molded from some convenient material, such as a hard plastic or the like, and the outer bearing surface 13, detent surface 17, and detent stow and extend slots 18 and 19 are all molded integrally into stem 10. Also, stem 10 is formed in two axially extending portions (generally two halves) for convenience in molding and the two portions are assembled or "clamshelled" together to provide the structure illustrated.

Figure 3:
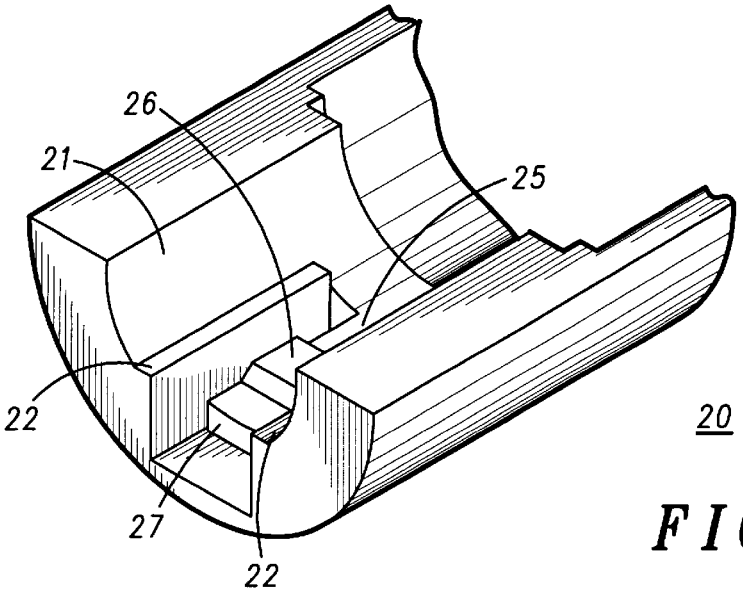
FIG. 3 is an isometric view of one portion of an antenna radome designed to mate with the stem of FIG. 1, in accordance with the present invention.

Turning now to FIG. 3, an apparatus carrying bearing 20 is illustrated. In this preferred embodiment, apparatus carrying bearing 20 is molded from some convenient material, such as a hard plastic or the like, and is formed in two axially extending portions (generally two halves) for convenience in molding. Only one of the portions is illustrated in FIG. 3 for convenience in viewing the various features, but it should be understood that a second portion (which could be a mirror image or could include no features except an inner bearing surface) is assembled or "clamshelled" over the illustrated portion to provide a complete structure. Further, in this preferred embodiment, apparatus carrying bearing 20 is formed as an integral portion of a radome housing an antenna (generally incorporated into the radome). Apparatus carrying bearing 20 includes an inner bearing surface 21 formed to mate with outer bearing surface 13 of stem 10 and slidably engage stem 10 for sliding movements between a stow position adjacent fixed end 11 and an extended position adjacent free end 12.

Apparatus carrying bearing 20 includes mating anti-rotation surfaces 22 which slidably engage anti-rotation surfaces 15 in stem 10, in the assembled orientation. The combination of anti-rotation surfaces 15 on stem 10 and mating anti-rotation surfaces 22 on apparatus carrying bearing 22 provide positive anti-rotation performance. A detent mechanism 25 is formed on apparatus carrying bearing 20 and includes a detent 26 spring biased against detent surface 17 of stem 10 in the assembled orientation so as to engage detent stow slot 18 when apparatus carrying bearing 20 is slid to the stow position and to engage detent extend slot 19 when apparatus carrying bearing 20 is slid to the extended position. In the embodiment illustrated in FIG. 3, detent 26 is positioned on the free end of a cantilever beam 27 which is constructed to provide the spring bias. Further, in this preferred embodiment, inner bearing surface 21. anti-rotation surfaces 22, cantilever beam 27, and detent 26 are molded into apparatus carrying bearing 20 during the molding operation to substantially reduce parts count, assembly operations, tolerance stackup, and costs.

Figure 4:
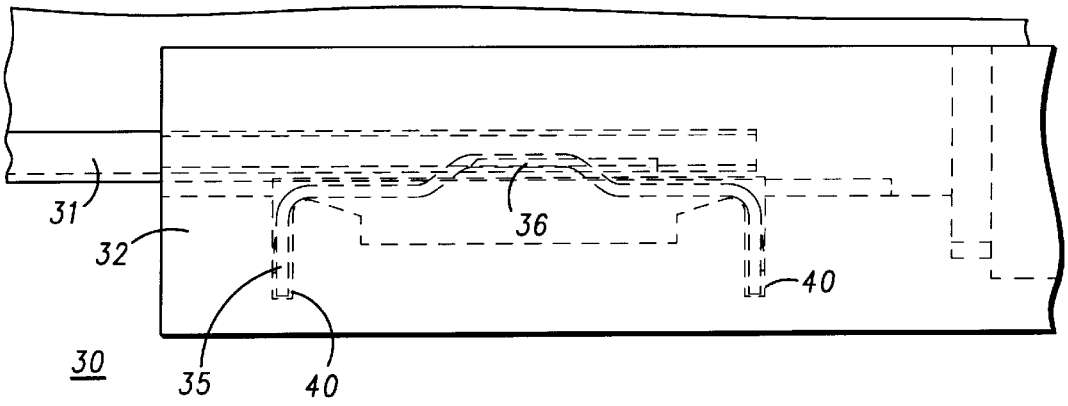
FIG. 4 is a sectional view, illustrating a different detent mechanism mounted in an antenna radome in accordance with the present invention.

Turning now to FIG. 4, another embodiment of extendable/stowable apparatus, designated 30, is illustrated.

Figure 5:
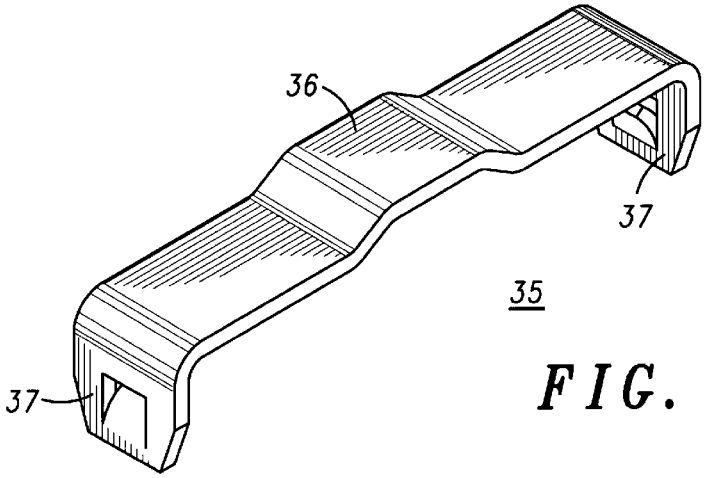
FIG. 5 is an enlarged isometric view of a spring detent mechanism used in the antenna radome of FIG. 4.

In this embodiment, a stem 31 is used which is substantially similar to stem 10 (described above) and, therefore, will not be described further. An apparatus carrying bearing 32 is similar to apparatus carrying bearing 20 except that cantilever beam 27 and detent 26 are replaced with a spring detent mechanism 35. Referring additionally to FIG. 5, it can be seen that spring detent mechanism 35 is formed from a single flat piece of spring metal with a detent 36 formed in the center and downwardly extending legs 37 formed for mounting the structure.

Figure 6:
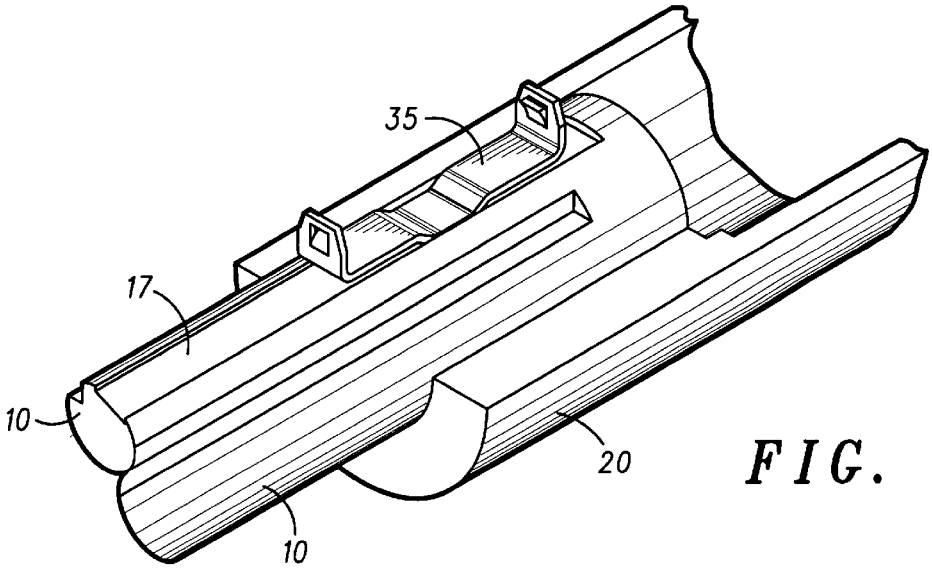
FIG. 6 is an isometric view of the antenna radome and detent mechanism of FIG. 4, portions thereof removed for purposes of illustration.

Turning again to FIG. 4, it can be seen that a pair of notches 40 are formed in apparatus carrying bearing 32 and receive legs 37 of detent mechanism 35 fixedly therein with detent 36 extending into the central opening defined by the inner bearing surface. As can be seen by referring to both FIGS. 4 and 6, detent 36 bears against detent surface 17 of stem 10 in the assembled orientation and is spring biased into engagement with detent stow slot 18 or detent extend slot 19. Bearing 32 is again fabricated in two axially extending portions, which allows for the easy assembly of detent mechanism 35 into apparatus carrying bearing 32. Only one of the portions is illustrated in FIG. 6 for convenience in viewing the various features but it should be understood that a second portion is assembled or "clamshelled" over the illustrated portion to provide a complete structure. Also, in this preferred embodiment, apparatus carrying bearing 32 is an integral portion of a molded radome incorporating an antenna.

Thus, extendable/stowable apparatus is disclosed which includes detents for providing positive positioning and anti-rotation surfaces for positively preventing relative rotation between the components. In a preferred embodiment, the apparatus carrying bearing is formed as an integral part of the apparatus, which substantially reduces part count, assembly operations, and costs. Also, the invention ensures detenting performance that depends less on tolerances of the other parts for proper action. Further, the reduced tolerance stackup by eliminating the separate bearing, results in more reliable sliding performance and more reliable anti-rotation features. In addition, because the separate bearings are eliminated, a smaller diameter and length can be achieved.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. Extendable/stowable apparatus comprising:

an elongated stem having a fixed end and an opposed free end, at least one anti-rotation surface on the stem extending from adjacent the fixed end to adjacent the free end;

an apparatus carrying bearing slidably engaged on the stem for sliding movements between a stow position at the fixed end and an extended position at the free end, the bearing including a mating anti-rotation surface slidably engaged with the anti-rotation surface on the stem; and a detent surface formed on one of the stem and the bearing and including a detent stow slot and a detent extend slot, and a detent mechanism formed on another of the stem and the bearing and including a detent spring biased against the detent surface so as to engage the detent stow slot when the bearing is slid to the stow position and to engage the detent extend slot when the bearing is slid to the extended position.

2. Extendable/stowable apparatus as claimed in claim 1 wherein the detent is formed adjacent a free end of a cantilever beam to provide the spring bias.

3. Extendable/stowable apparatus as claimed in claim 1 wherein the detent is attached to a spring mounted on the bearing to provide the spring bias.

4. Extendable/stowable apparatus as claimed in claim 1 wherein the bearing defines an elongated opening designed to receive the elongated stem therein.

5. Extendable/stowable apparatus as claimed in claim 4 wherein the stem has an outer surface and the at least one anti-rotation surface on the stem is a portion of the outer surface.

6. Extendable/stowable apparatus as claimed in claim 5 wherein the at least one anti-rotation surface includes an elongated slot formed in the stem and extending from adjacent the fixed end to adjacent the free end and the mating anti-rotation surface on the bearing includes a projection that extends into and slidably engages the elongated slot.

7. Extendable/stowable apparatus as claimed in claim 4 wherein the elongated opening in the bearing defines an inner bearing surface and the stem has an outer surface that defines an outer bearing surface which mates with the inner bearing surface and provides for sliding movements between a stow position at the fixed end and an extended position at the free end.

8. Extendable/stowable apparatus as claimed in claim 1 wherein the elongated stem is molded and the bearing is molded into an antenna structure, and the at least one anti-rotation surface, the detent surface, and the detent stow and extend slots are molded into one of the elongated stem and the bearing, and the mating anti-rotation surface and the detent mechanism are molded into the other of the elongated stem and the bearing.

9. Extendable/stowable apparatus as claimed in claim 1 wherein the elongated stem is molded and the at least one anti-rotation surface, the detent surface, and the detent stow and extend slots are molded into the elongated stem.

10. Extendable/stowable apparatus as claimed in claim 1 wherein the bearing is molded into an antenna structure and the mating anti-rotation surface and the detent mechanism are molded into the antenna structure.

11. Extendable/stowable antenna apparatus comprising:

an elongated antenna stem having a fixed end and an opposed free end, at least one anti-rotation surface on the antenna stem extending from adjacent the fixed end to adjacent the free end, and a detent surface on the antenna stem including a detent stow slot adjacent the fixed end and a detent extend slot adjacent the free end; and an antenna structure including an antenna carrying bearing formed therein, the antenna carrying bearing being slidably engaged on the antenna stem for sliding movements between a stow position at the fixed end and an extended position at the free end, the bearing including a mating anti-rotation surface slidably engaged with the anti-rotation surface on the antenna stem, and a detent mechanism including a detent spring biased against the detent surface on the antenna stem so as to engage the detent stow slot when the bearing is slid to the stow position and engage the detent extend slot when the bearing is slid to the extended position.

12. Extendable/stowable antenna apparatus as claimed in claim 11 wherein the detent mechanism includes a cantilever beam designed to provide the spring bias, the cantilever beam is formed in the antenna structure and includes a detent adjacent an end of the beam.

13. Extendable/stowable antenna apparatus as claimed in claim 11 wherein the detent is attached to a spring mounted in the antenna structure to provide the spring bias.

14. Extendable/stowable antenna apparatus as claimed in claim 11 wherein the antenna structure includes an elongated opening formed therein and designed to define the antenna carrying bearing and slidably receive the elongated antenna stem therein.

15. Extendable/stowable antenna apparatus as claimed in claim 14 wherein the antenna structure is formed as a pair of molded components that fit together to define the elongated opening.

16. Extendable/stowable antenna apparatus as claimed in claim 14 wherein the antenna stem has an outer surface and the at least one anti-rotation surface on the antenna stem is a portion of the outer surface.

17. Extendable/stowable antenna apparatus as claimed in claim 16 wherein the at least one anti-rotation surface includes an elongated slot formed in the antenna stem and extending from adjacent the fixed end to adjacent the free end and the mating anti-rotation surface on the antenna carrying bearing includes a projection formed in the antenna structure that extends into and slidably engages the elongated slot.

18. Extendable/stowable antenna apparatus as claimed in claim 14 wherein the elongated opening in the antenna carrying bearing defines an inner bearing surface and the antenna stem has an outer surface that defines an outer bearing surface which mates with the inner bearing surface and provides for sliding movements between a stow position at the fixed end and an extended position at the free end.

19. Extendable/stowable antenna apparatus as claimed in claim 11 wherein the elongated antenna stem is molded and the at least one anti-rotation surface, the detent surface, and the detent stow and extend slots are molded into the elongated antenna stem.

20. Extendable/stowable antenna apparatus as claimed in claim 11 wherein the antenna carrying bearing is molded into the antenna structure and the mating anti-rotation surface and the detent mechanism are molded into the antenna structure.

21. Extendable/stowable antenna apparatus comprising:

a molded elongated antenna stem having a fixed end and an opposed free end, the antenna stem being molded with an outer bearing surface and at least one anti-rotation surface molded into the antenna stem and extending from adjacent the fixed end to adjacent the free end, and a detent surface molded into the antenna stem and including a detent stow slot adjacent the fixed end and a detent extend slot adjacent the free end; and a molded antenna radome having an elongated opening molded therein, the elongated opening of the radome being molded with an inner bearing surface designed to mate with the outer bearing surface of the antenna stem, the inner bearing surface of the elongated opening of the radome and the outer bearing surface of the antenna stem being slidably engaged for sliding movements between a stow position at the fixed end of the antenna stem and an extended position at the free end of the antenna stem, a mating anti-rotation surface molded into the elongated opening of the radome and slidably engaged with the anti-rotation surface on the antenna stem, and a detent mechanism positioned in the elongated opening of the radome and including a detent spring biased against the detent surface on the antenna stem so as to engage the detent stow slot when the bearing is slid to the stow position and engage the detent extend slot when the bearing is slid to the extended position.

* * * * *